United States Patent [19]

Bronkowski et al.

[11] Patent Number: 4,718,159

[45] Date of Patent: Jan. 12, 1988

[54] APPARATUS FOR TERMINATING AN ELECTRICAL WIRE TO AN ELECTRICAL CONNECTOR

[75] Inventors: Udo Bronkowski, Neu-Isenburg; Michael Gerst, Worms; Werner Maack, Seeheim, all of Fed. Rep. of Germany

[73] Assignee: AMP Incorporated, Harrisburg, Pa.

[21] Appl. No.: 937,152

[22] Filed: Dec. 2, 1986

[30] Foreign Application Priority Data

Dec. 31, 1985 [GB] United Kingdom ..... 8531954

[51] Int. Cl.[4] ..... H01R 43/00

[52] U.S. Cl. ..... 29/564.7; 29/749

[58] Field of Search ..... 29/563, 564, 564.1, 29/564.2, 564.3, 566.3, 564.6, 564.7, 564.8, 857, 749, 751

[56] References Cited

U.S. PATENT DOCUMENTS 4,040,179 8/1977 Sanchez ..... 29/751
4,441,251 4/1984 Grubb et al. ..... 29/566.3
4,525,927 7/1985 Guerout et al. ..... 29/749
4,584,757 4/1986 Adlon et al. ..... 29/564.6

FOREIGN PATENT DOCUMENTS 2134422 8/1984 United Kingdom .

*Primary Examiner*—Z. R. Bilinsky
*Attorney, Agent, or Firm*—Thomas G. Terrell

[57] ABSTRACT

The apparatus is for terminating wires (W) to terminals (8) in a connector housing (4), for shearing from the housing (4), a cover (14) which is hinged thereto and for placing the cover (14) on the housing (4) to cover the connections. The connector housing (4) is conveyed by means of a first shuttle (50) to a cover shearing station (CS) at which the cover (14) is sheared from the housing (4) and is driven into a second shuttle (84). The first shuttle (50) is then moved to a terminating station (TS) at which wires are terminated to the terminals (8) by tooling (130) after which the second shuttle (84) is moved to the terminating station (TS) and the tooling (130) is operated to drive the severed cover (14) from the second shuttle (84) onto the connector housing (4).

11 Claims, 23 Drawing Figures

P
14
LS
2

14
B
P
2
CS
A 2
4
A
W
TS
14
LS
P
CS
C
14
W
TS

2
D
14
2
W
CS
P
LS
TS
4

P
CS
LS

APPARATUS FOR TERMINATING AN ELECTRICAL WIRE TO AN ELECTRICAL CONNECTOR

This invention relates to apparatus for terminating an electrical wire to an electrical terminal in a cavity in an insulating connector housing, and for mating with the housing, a cover hinged thereto, to enclose the electrical connection so provided.

U.S. Pat. No. 4,040,179 discloses such apparatus, which comprises a connector housing loading station, a wire terminating and cover mating station, means for supplying the connector housing from said loading station to said terminating station, a wire terminating and cover mating took and means for repeatedly driving said tool through a working stroke towards the terminating station.

In this known apparatus the terminating tool is arranged first to terminate the wire to the terminal and then to close the cover about its hinge, so as to mate the cover with the housing. The cover is provided with a wire hold down projection, which is necessarily moved through an arcuate path as the cover is moved to its closed position and which may thereby engage edges of the terminal, during the closure movement, and thereby be damaged.

Apparatus according to the invention is characterized by means for guiding the tool rectilinearly through its working stroke, a cover removal station provided between the loading station and the terminating station, means at the cover removal station for removing the cover from the housing and means for then transferring the cover to the terminating station to position the cover between the terminating tool and the connector housing when the wire has been terminated by means of the tool and the tool has been driven through its return stroke, to cause the cover to be driven onto the housing by the tool during the next following working stroke thereof.

Since the cover is driven by the tool along a rectilinear path onto the housing, any wire hold down projection provided on the cover is driven directly against the wire, with substantially less danger of being damaged by contact with the terminal, than in the case of the known apparatus.

Although there is described in U.S. Pat. No. 4,525,927, apparatus for terminating a wire to an electrical terminal in a cavity in an insulating housing, and then driving a cover down rectilinearly onto the housing, the cover is not hinged to the housing and must, therefore, be separately supplied and separately handled.

The means for transferring the connector housing from the loading station to the terminating station may comprise a first transfer shuttle into which the housing is loaded at the loading station and which is movable via the cover removal station to the terminating station, the shuttle being arranged to dwell at the cover removal station, at which a shearing member is movable to shear the cover from the housing and to drive it into a second transfer shuttle, which is movable along a second rectilinear path, from the removal station to the terminating station.

Means may be provided for blocking the movement of the first shuttle from the cover removal station towards the terminating station, until the cover has been sheared from the connector housing and has been lodged in the second shuttle.

The second transfer shuttle may have a cover receiving opening into which the cover is driven by the shearing means, against the action of spring loaded cover retaining members projecting into the opening for retaining the cover therein during the movement of the second shuttle to the terminating station and releasable latch means may be provided for retaining the housing in the first shuttle during its transfer from the loading station to the terminating station.

For a better understanding of the invention, reference will now be made by a way of example to the accompanying drawings in which.

Figure 1:
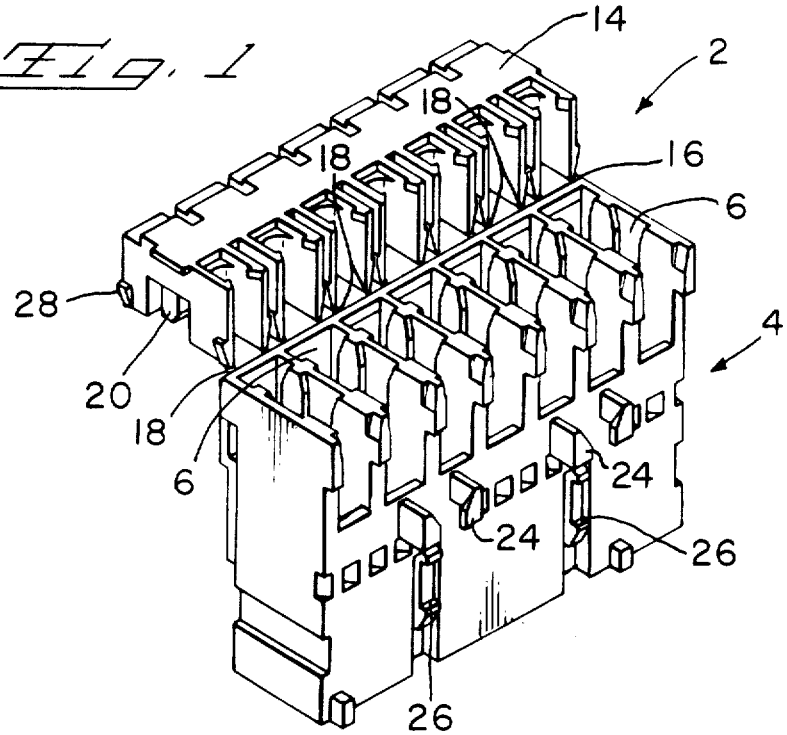
FIG. 1 is a perspective view of an electrical connector having a cover hinged thereto.
Figure 6:
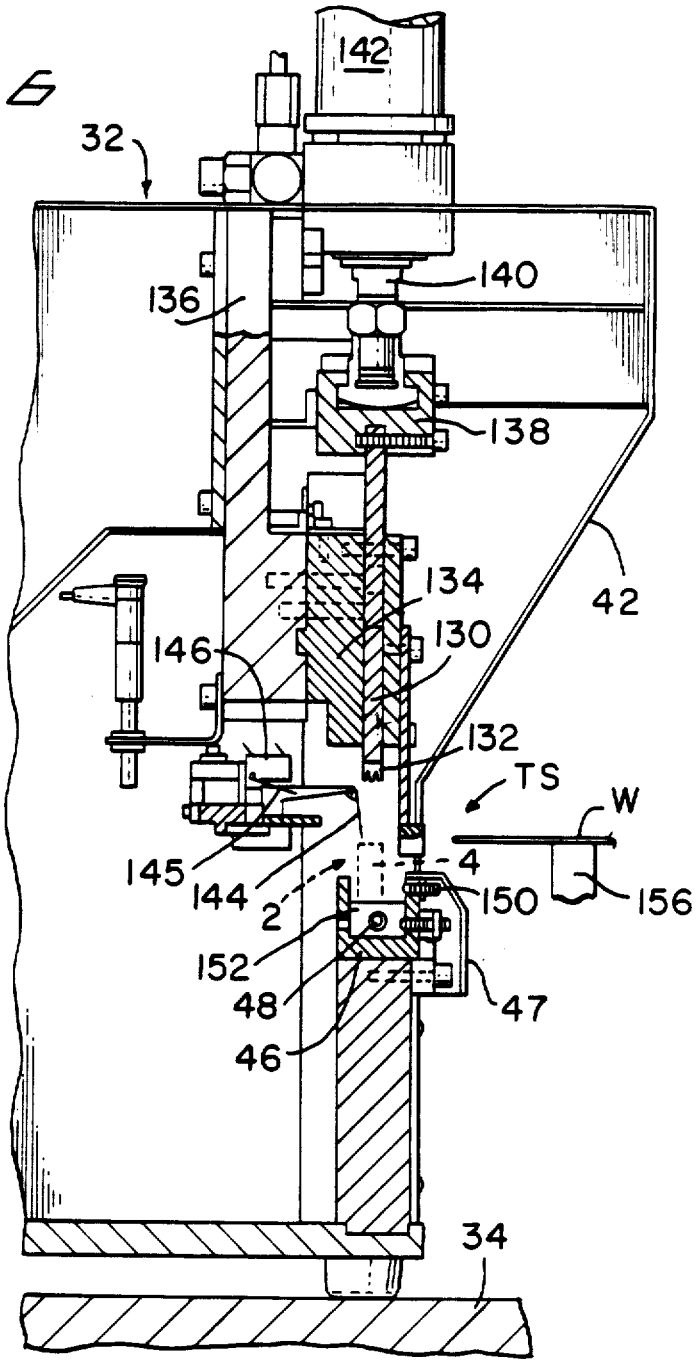
Figure 7:
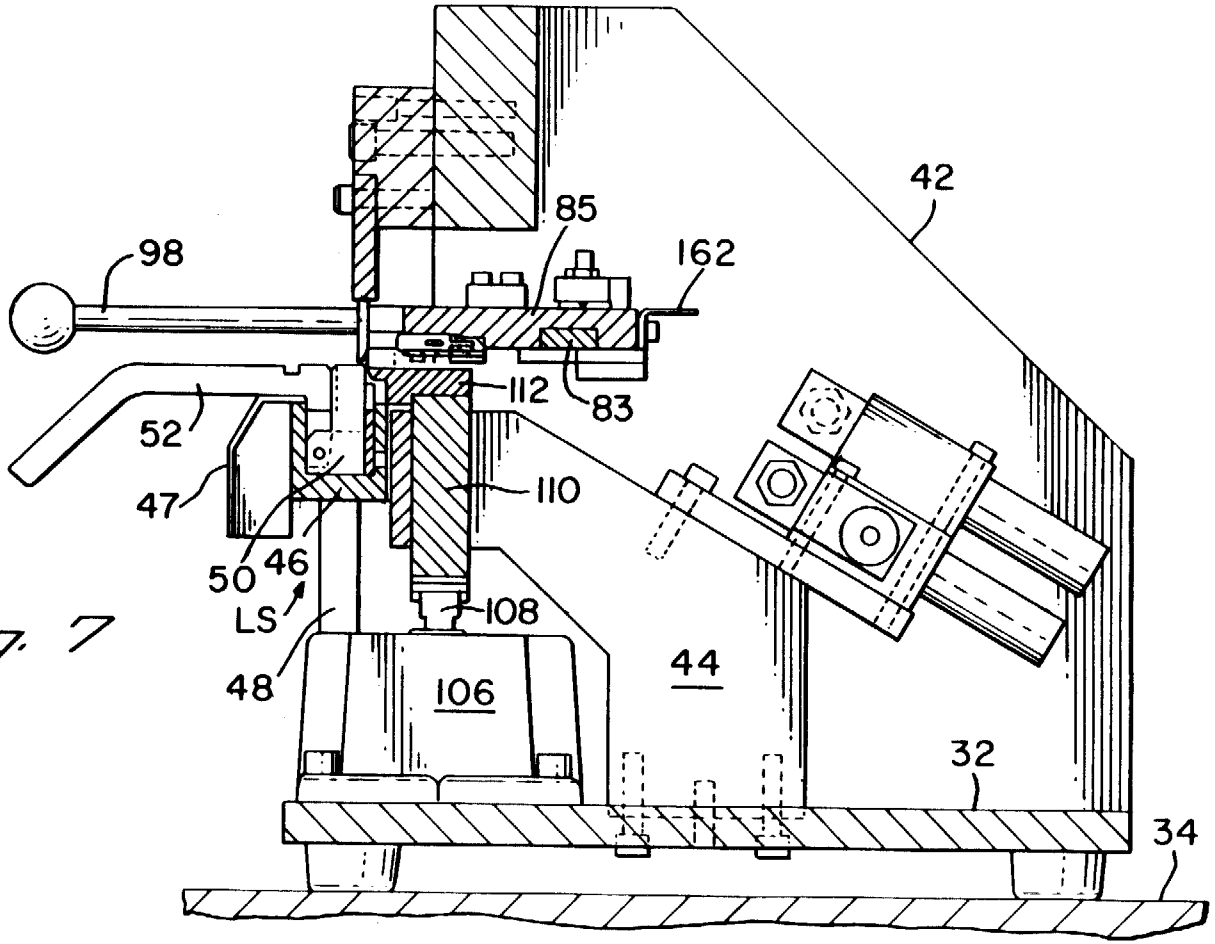
Figure 8:
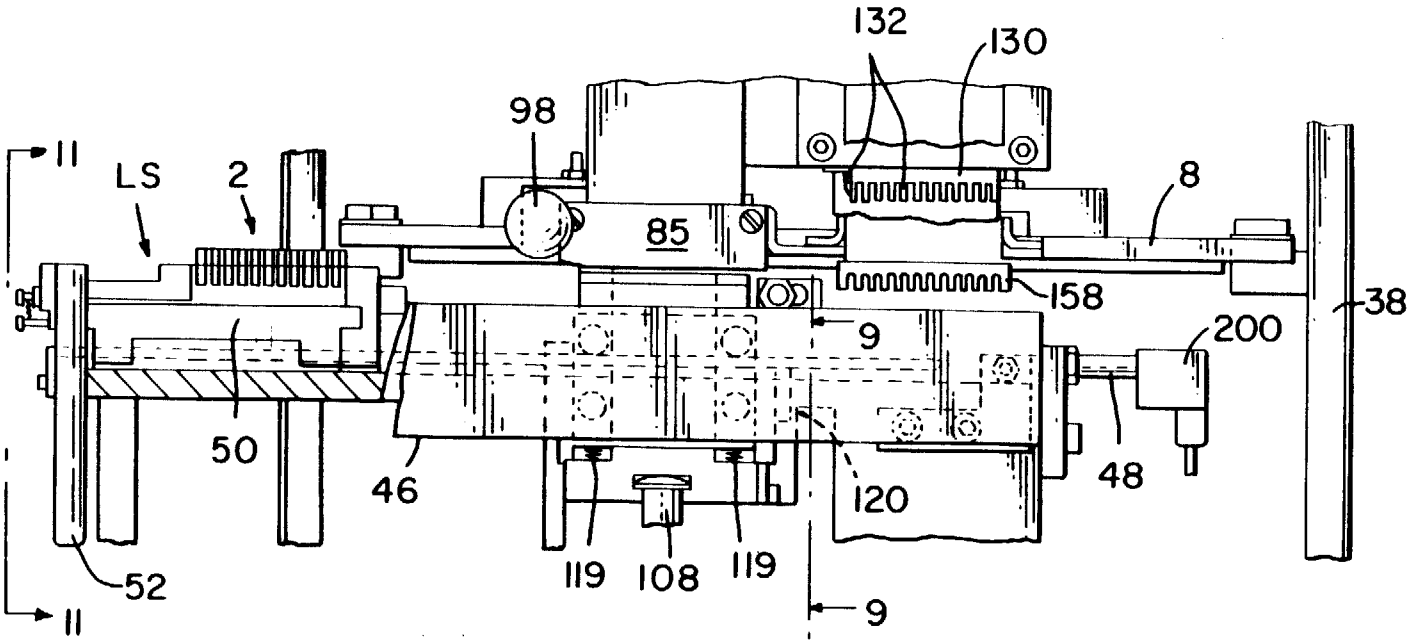
Figure 9:
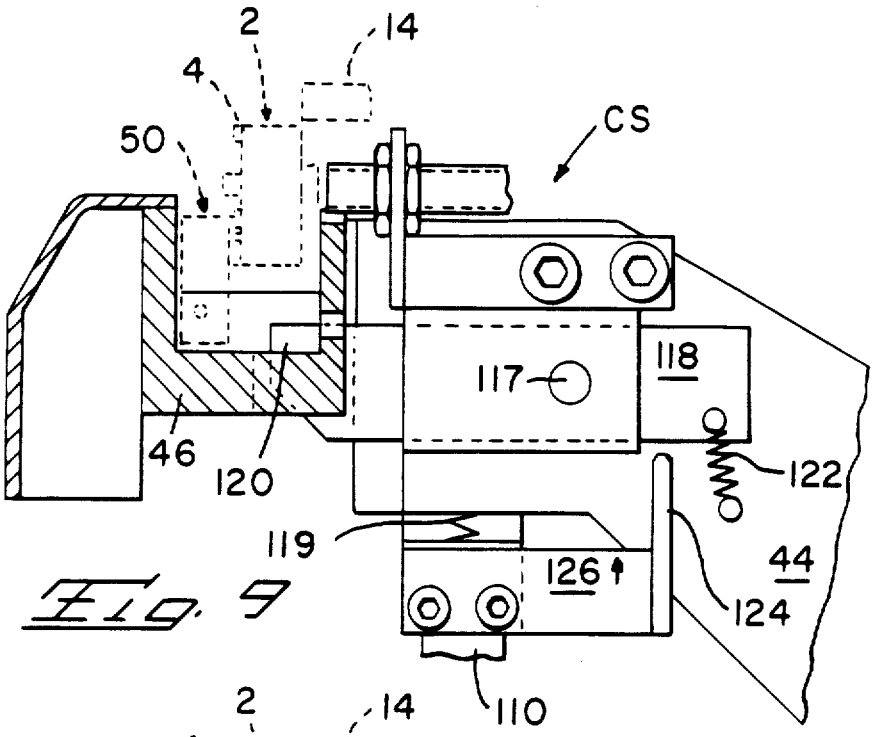
Figure 10:
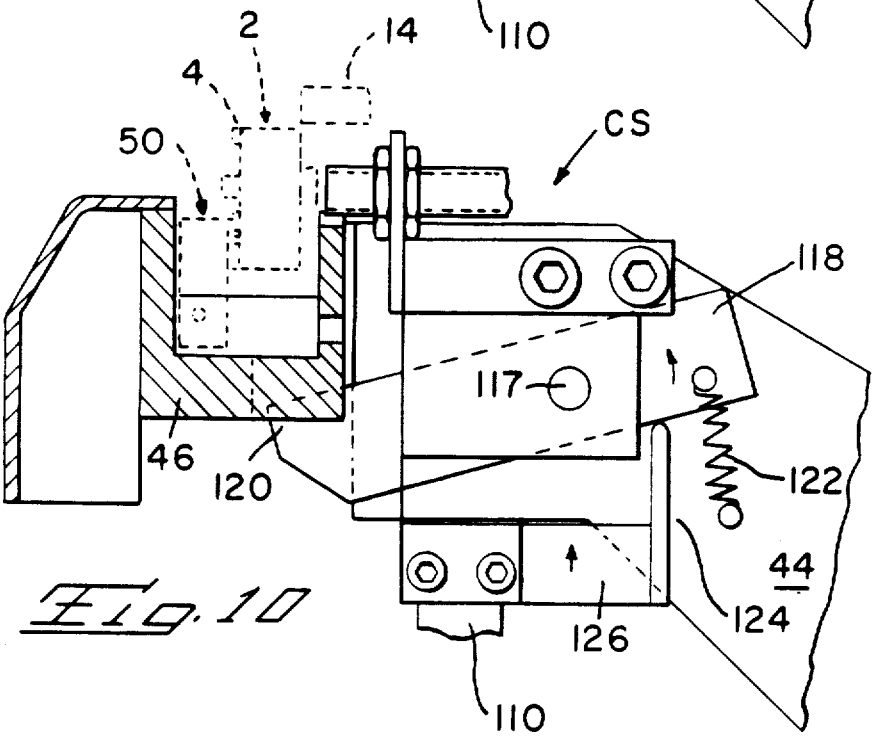
Figure 11:
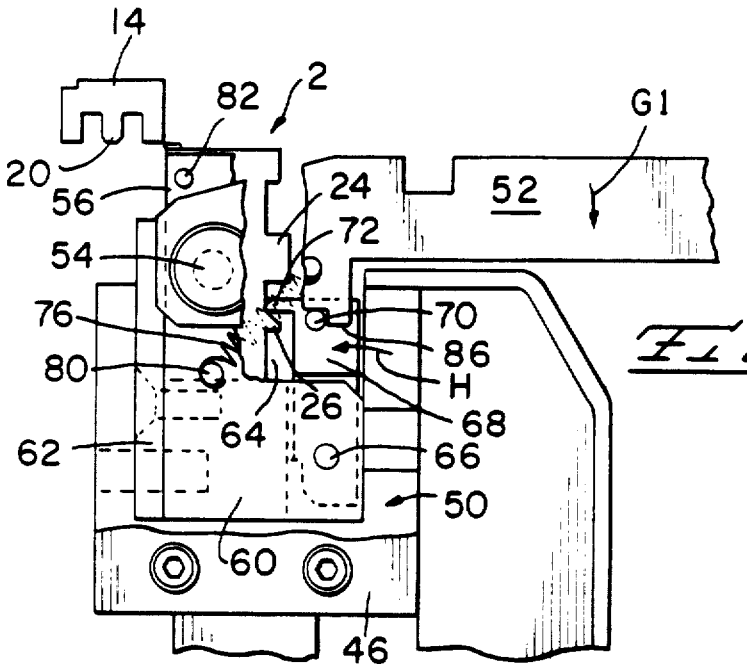
Figure 12:
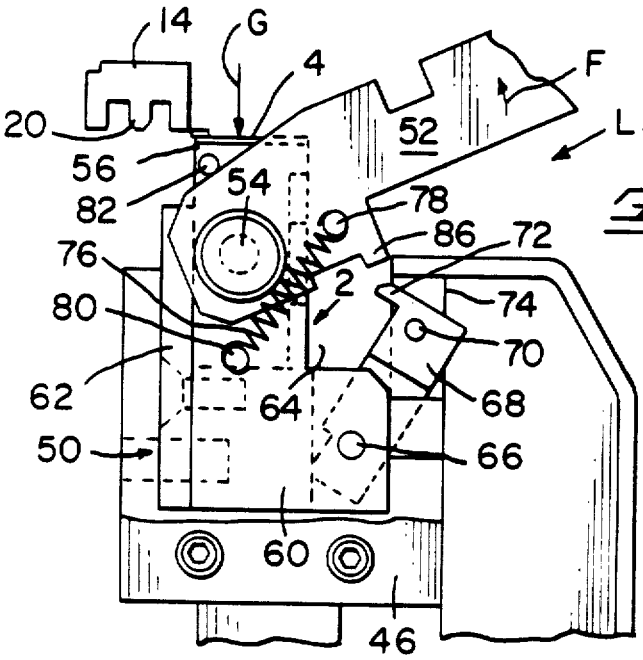
Figure 13:
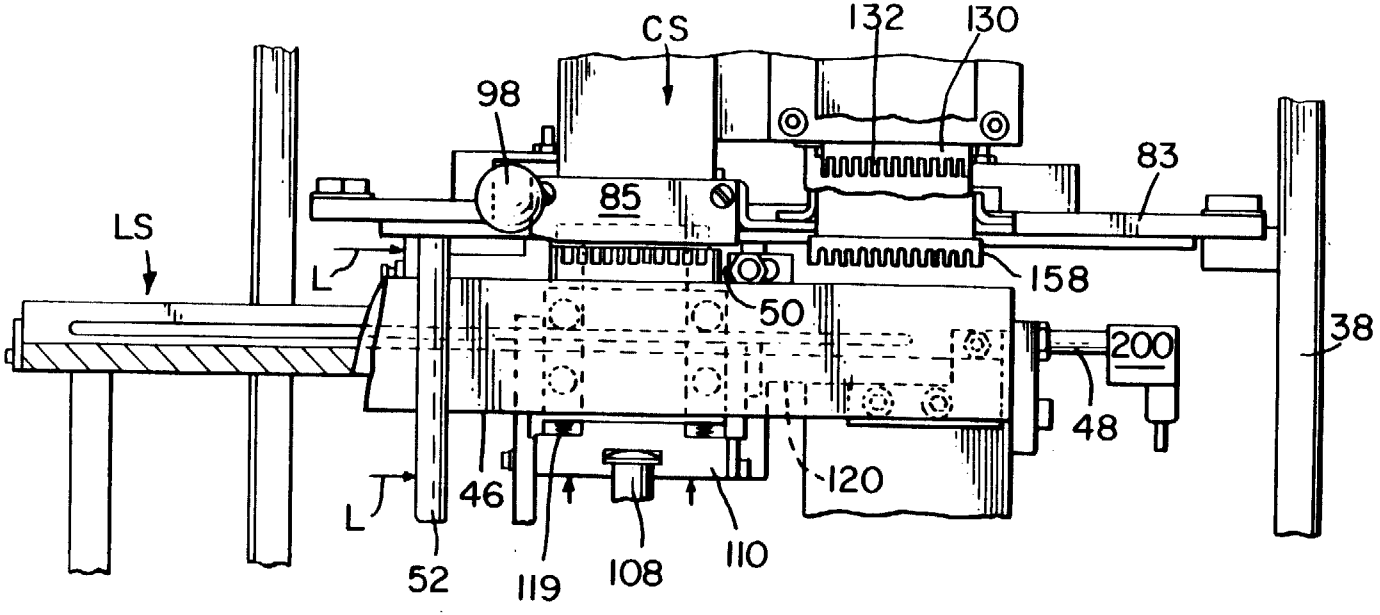
Figure 14:
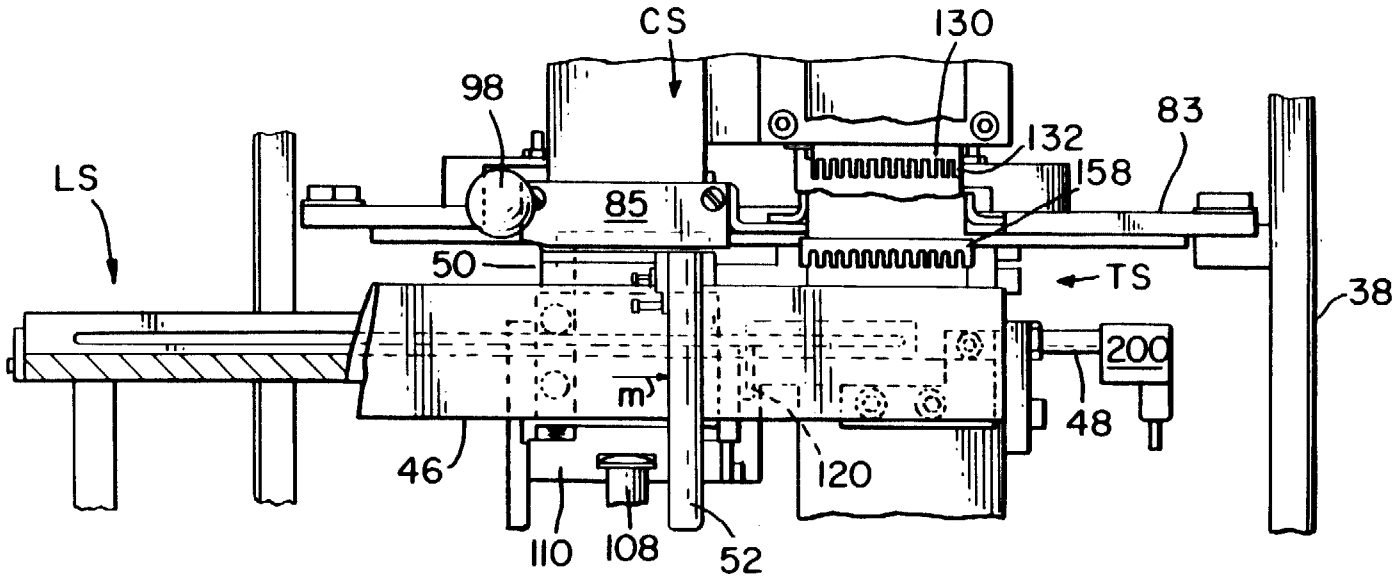
Figure 15:
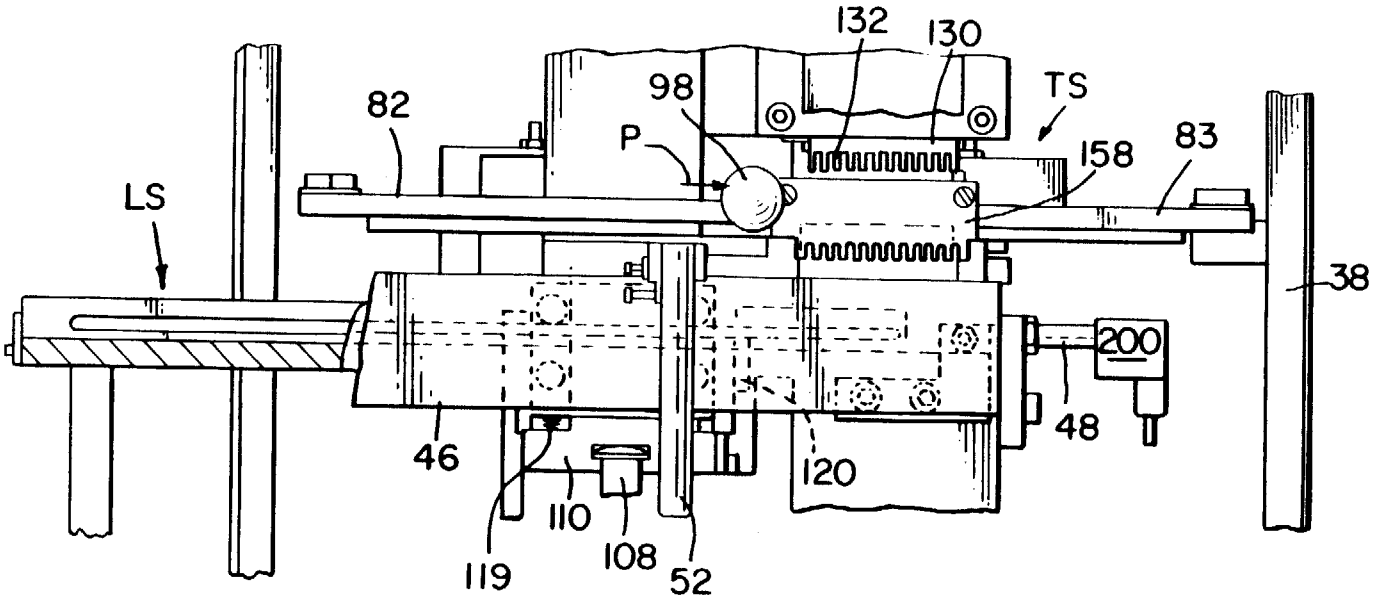
Figures 16, 17:
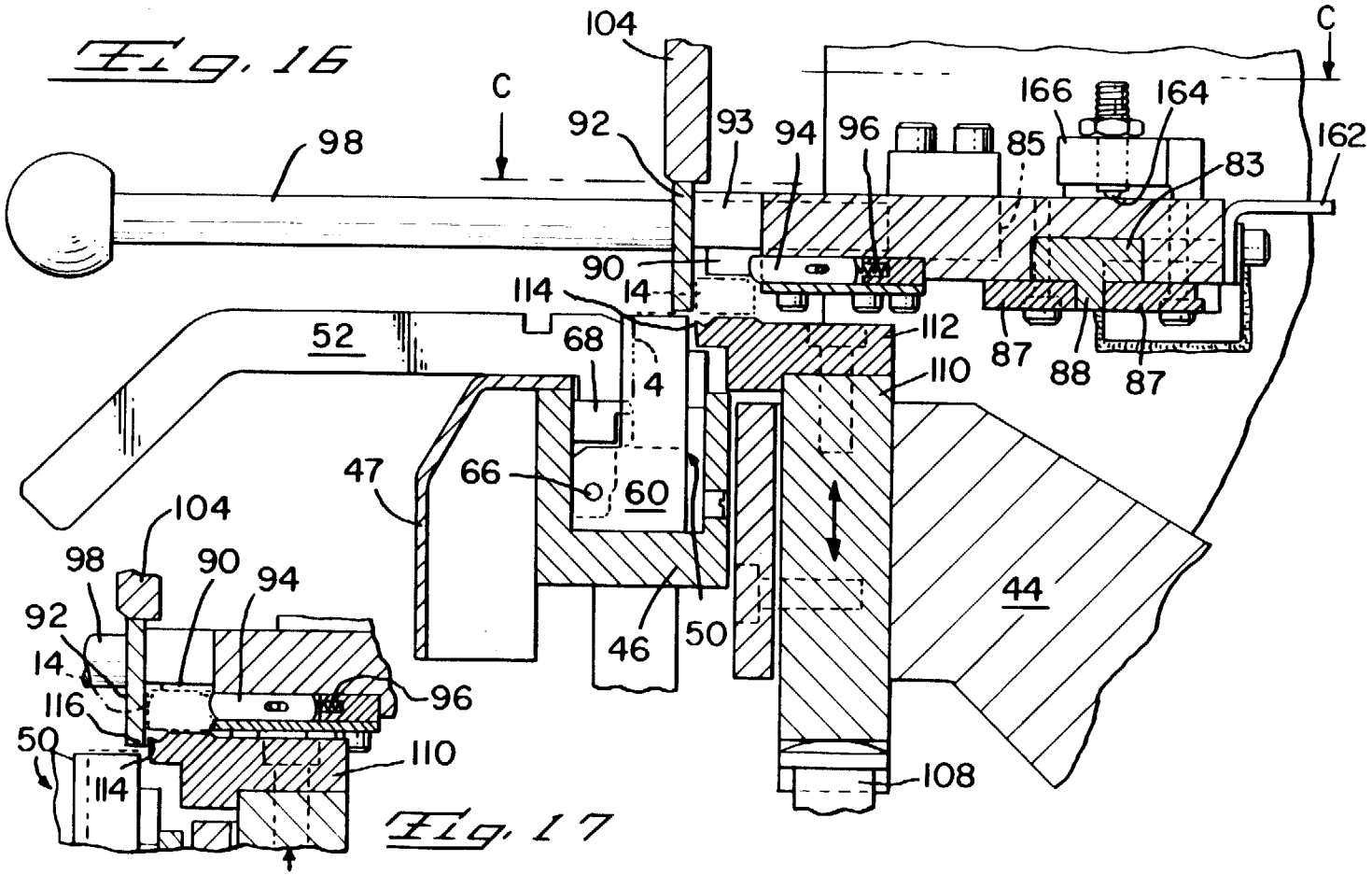
Figure 18:
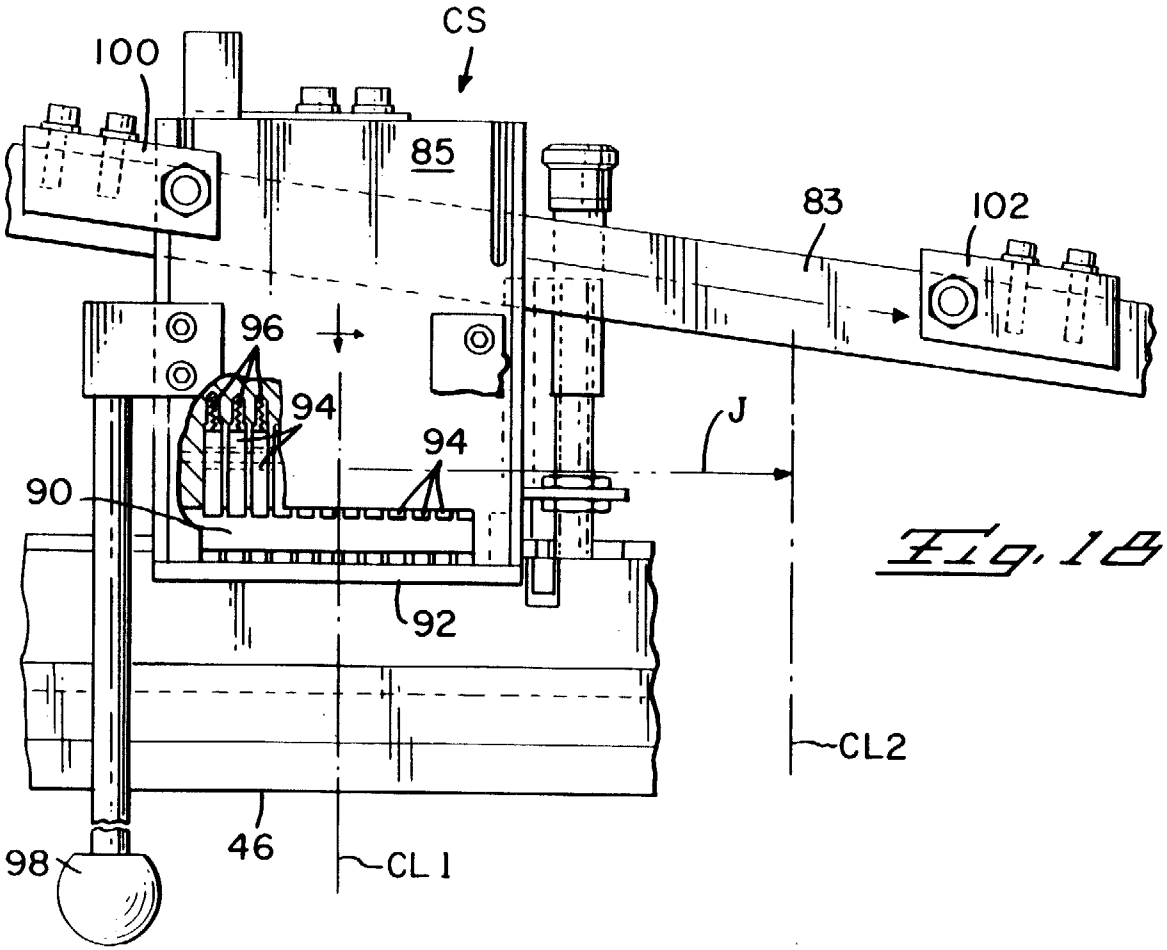

FIGS. 6 and 7 are views taken on the lines 6—6 and 7—7, respectively, of FIG. 1;

FIG. 8 is an enlarged, fragmentary, front view of the apparatus in a starting condition, and with parts removed;

FIG. 9 is a view taken on the lines 9—9 of FIG. 8;

FIG. 10 is a similar view to that of FIG. 9, but showing the parts shown in FIG. 9 in different relative positions;

FIG. 11 is a view taken on the lines 11—11 of FIG. 8;

FIG. 12 is a similar view to that of FIG. 11, but showing the parts shown in FIG. 11 in different relative positions;

FIGS. 13 to 15 are views similar to that of FIG. 8, but illustrating respective successive stages in a cycle of operation of the apparatus;

FIG. 16 is a cross-sectional view through a lid removal station of the apparatus, showing a lid transfer shuttle positioned to receive a connector lid at said station;

FIG. 17 is a fragmentary view showing details of FIG. 16 and illustrating the manner in which a connector cover is received by the shuttle for transfer thereby;

FIG. 18 is a view taken on the lines 18—18 of FIG. 16; and

Figure 19:
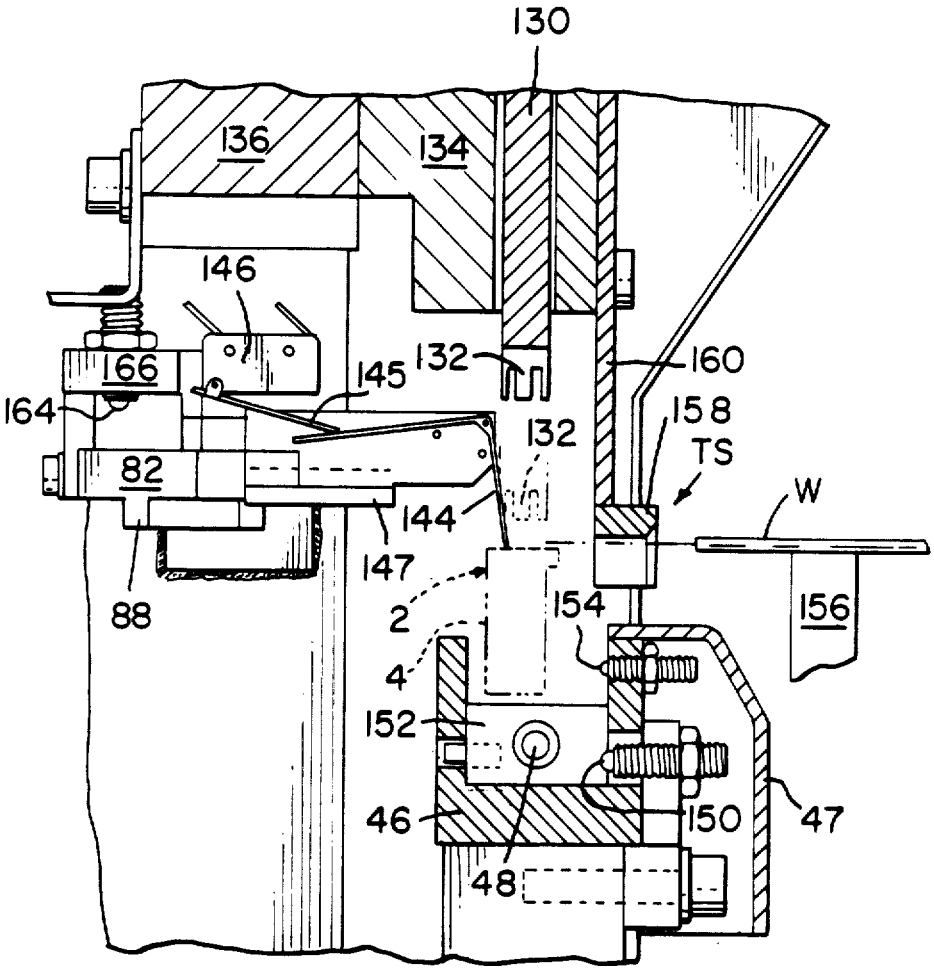

FIG. 19 is an enlarged view illustrating details of FIG. 6.

Figure 3:
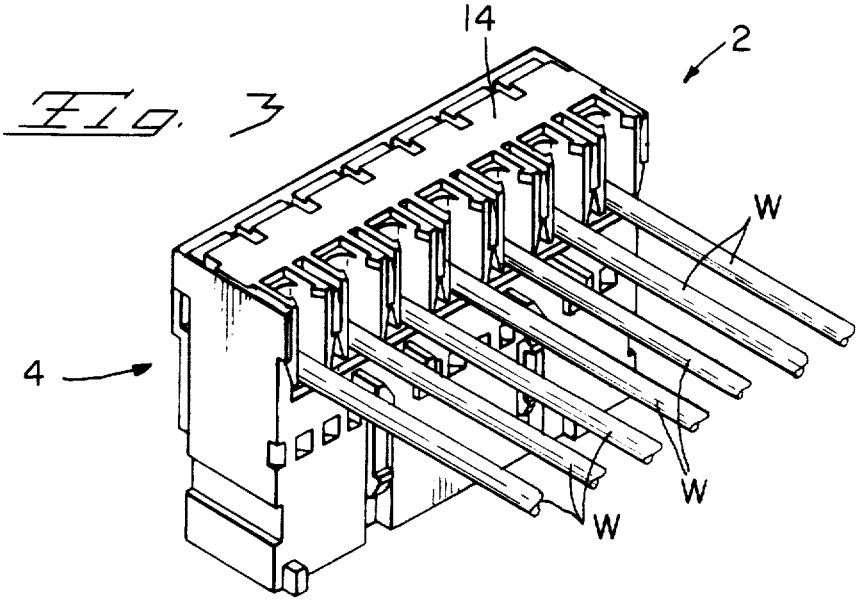
FIG. 3 is a perspective view of the connector showing a wire terminated to each terminal thereof and with the cover positioned on the connector to hold the wires in position in the terminals.
Figure 2:
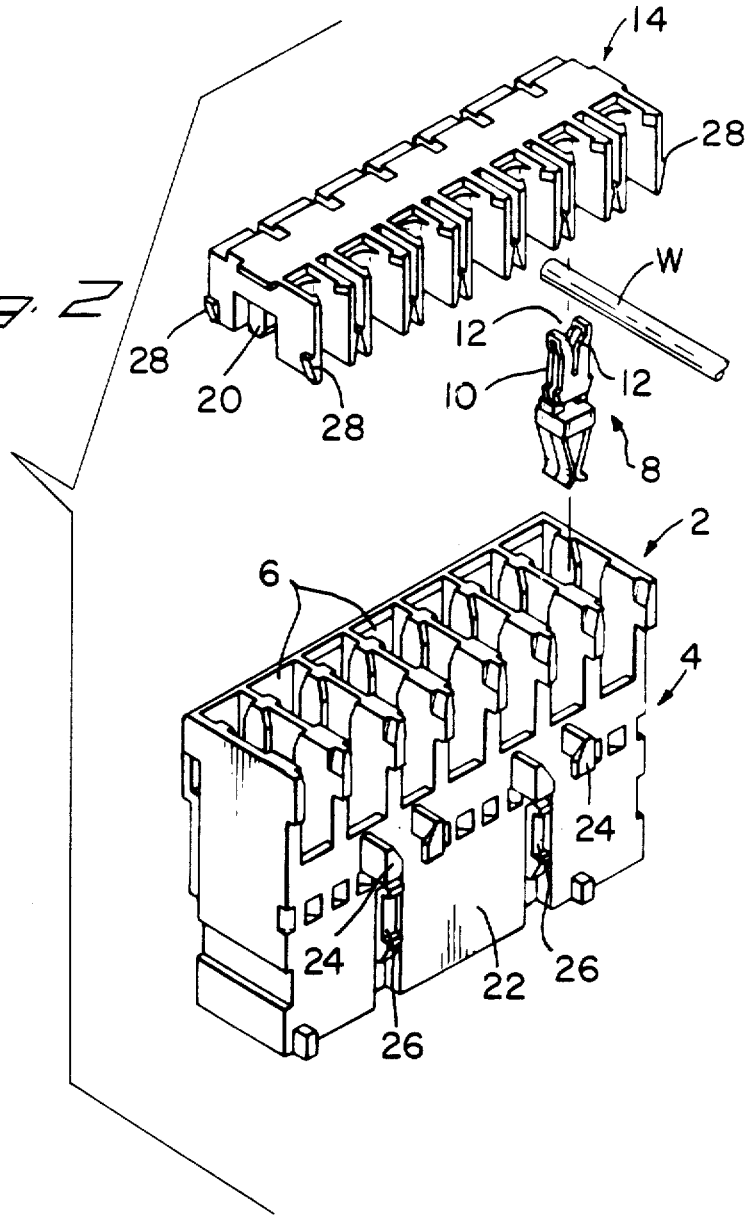
FIG. 2 is a perspective view of the connector with the cover removed therefrom and positioned above the connector, a terminal thereof being shown as being exploded from the connnector, and a wire to be terminated to the terminal.

As shown in FIGS. 1 and 2, an electrical connector 2 comprises an insulating housing 4 defining a row of terminal receiving cavities 6 each for receiving an electrical terminal 8 having a wire receiving portion 10 formed with opposed wire receiving slots 12 for the reception of an insulated wire W inserted into the slots 12 in a direction at right angles to the longitudinal axis of the wire W, so that the edges of the slots 12 pierce the insulation of the wire to make electrical contact with the electrically conductive core thereof. As shown in FIG. 1, the housing 4 has a cover 14 connected to its rear wall 16 by means of hinges 18 formed integrally with the housing 4. The cover 14 is formed with a row of wire hold down fingers 20, one for each cavity 7. On the front wall 22 of the housing 4 are two pairs of hooks 24 beneath which is a latch member 26 for latching the connector 2 to a mating connector (not shown). In use of the connector 2, when wires W have each been inserted into the wire receiving slots 12 of a respective terminal 8 in its cavity 6, the cover 14 is removed and is placed over the cavities 6 as shown in FIG. 3 so that each figner 20 serves to hold down a respective wire W in the wire receiving slots of a respective terminal 8. The cover 14 is provided with latch members 28 for securing it to the housing 4.

Figures 4A, 4B, 4C, 4D, 4E:
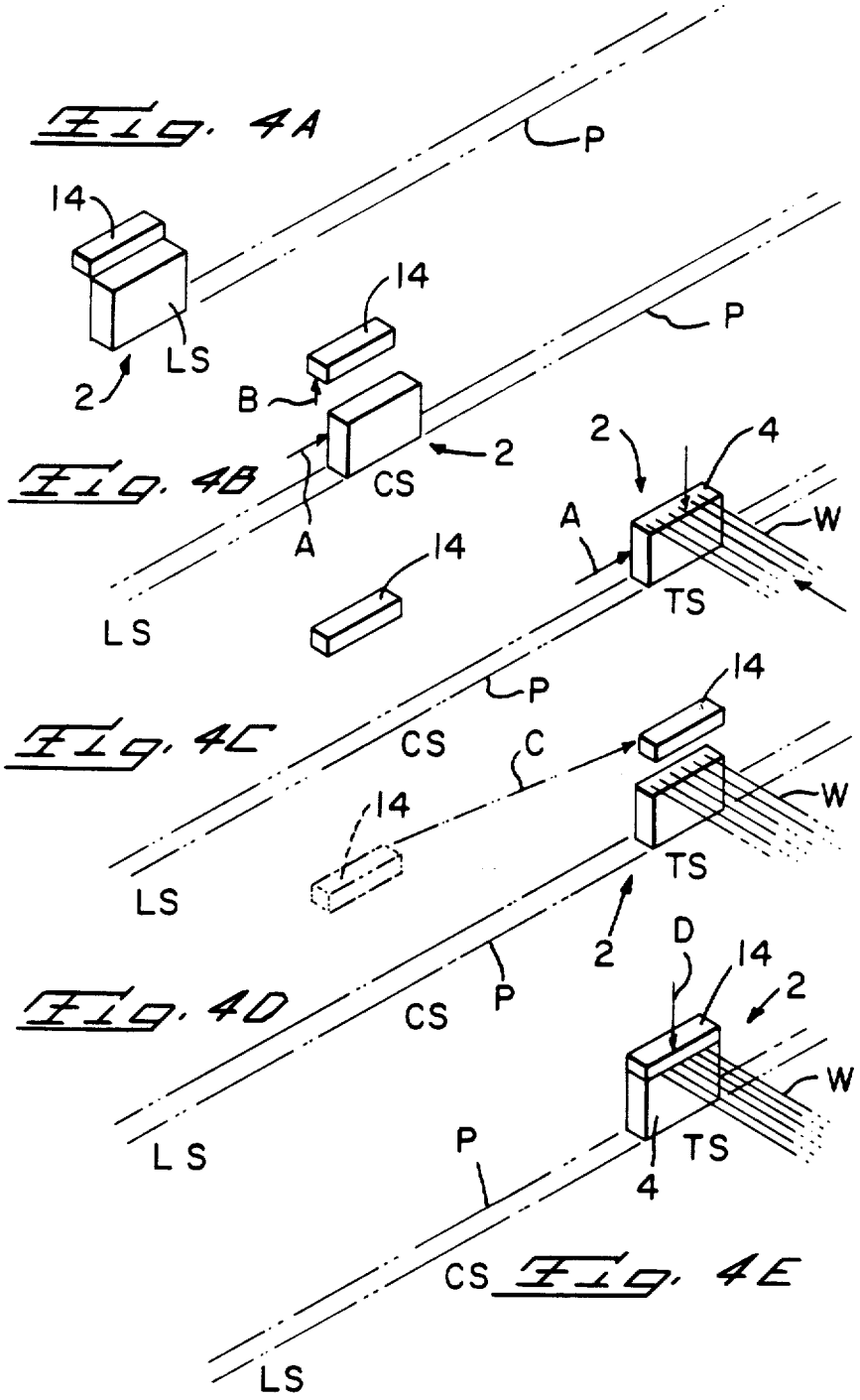
FIGS. 4A to 4E are diagrammatic perspective views illustrating functions to be performed by apparatus for removing the cover from the connector, terminating the wires to the terminals, and then positioning the cover on the connector to hold the wires in position in the terminals.

The functions performed by means of the apparatus to be described below, will now be described with reference to FIGS. 4A to 4E. The connector 2 with its cover 14 extending at right angles thereto being, that is to say, in its FIG. 1 position, is advanced along a connector slide path, from a connector loading station LS (FIG. 4A) to a cover removal station CS (FIG. 4B) in the direction indicated by the arrow A in FIG. 4B, at which station the cover 14 is sheared from the connector 2 and is raised in the direction of the arrow B in FIG. 4B. The connector 2 is then advanced along the path P, further in the direction of the arrow A, to a wire terminating station TS, the cover 14 remaining at the station CS in its raised position, as shown in FIG. 4C. At the station TS, the wires W are sequentially terminated, one by one, to the terminals 8. When a wire has been inserted into the wire slots 12 of each of these terminals, the cover 14 is advanced from the station CS along an inclined path indicated by the arrow C in FIG. 4D to a position above the connector 2, with each wire hold down finger 20 of the cover 14 in alignment with a respective one of the wire connecting portions 10 of the terminals 8. The cover 14 is then driven down in the direction of the arrow D in FIG. 4E so as to be latched to the housing 4 whereby the fingers 20 hold the wires down in the wire slots 12.

Figure 5:
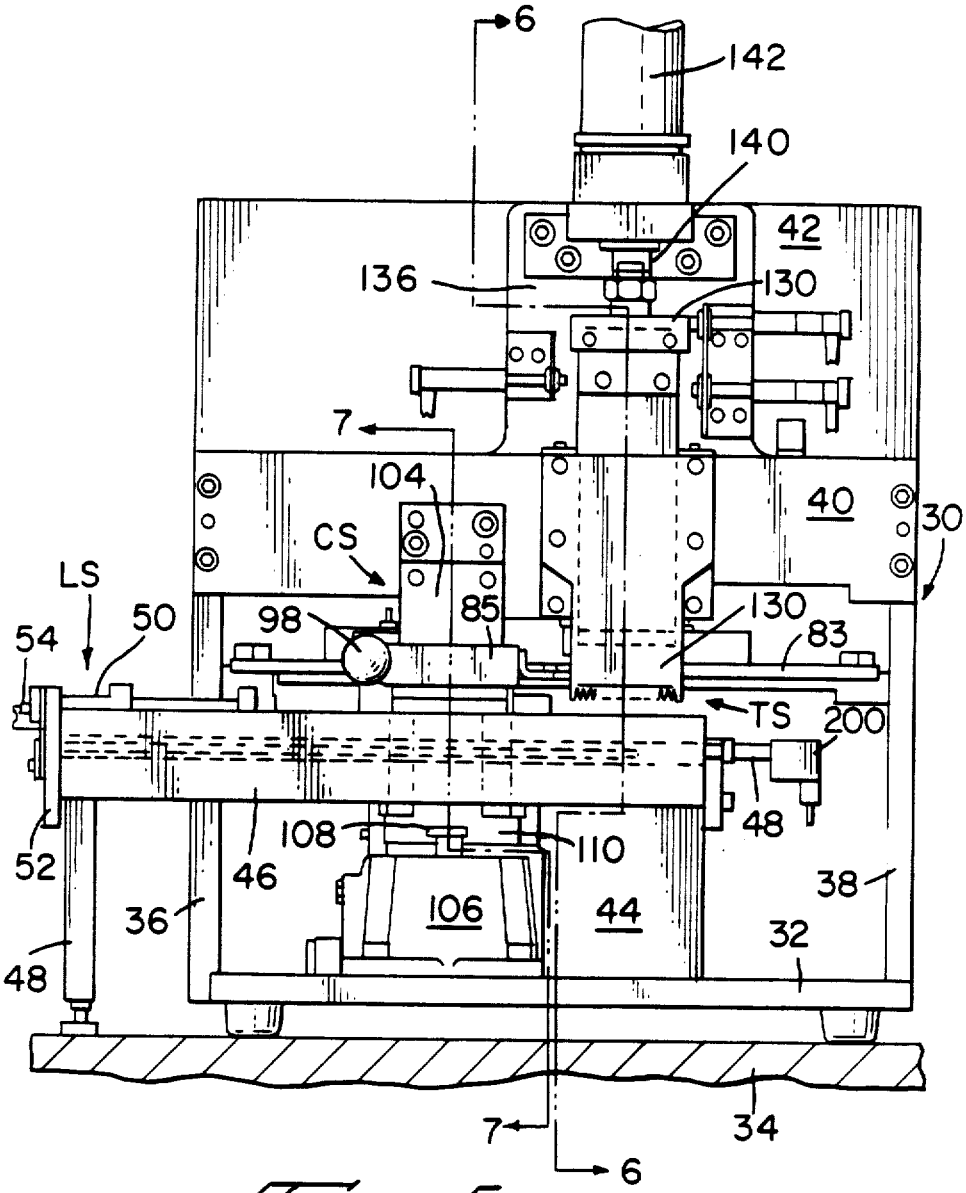
FIG. 5 is a front view of the apparatus in a starting condition, and with parts removed.

The apparatus will now be described with reference to FIGS. 5 to 19. The apparatus comprises a frame 30 having a base plate 32 for mounting on a workbench 34 as shown in FIG. 5. The frame comprises side plates 36 and 38 connected by a front plate 40, and a guard 42.

Mounted on the base plate 32 by way of a bracket 44 is a slide way 46, the left hand (as seen in FIG. 5) end of which projects from the frame 30 at the station LS, for easy operator access and is supported on the work bench 34 by means of an adjustable leg 48. In the slide way 46 is mounted a connector transfer shuttle 50 which is slideable along a guide rod 48 in the guideway 46, between the loading station LS and the terminating station TS. A guard 47 extends along the front side of the guideway 46. The shuttle 50 is slideable manually between the stations LS and TS by means of a handle 52 which is pivotally connected by means of a pivot pin 54 to an end wall 56 of the shuttle 50, as best seen in FIGS. 11 and 12. The end wall 56 is secured to a base block 60 of the shuttle 50, to which block is in turn secured, a side wall 62 cooperating with the base 60 to define a connector receiving recess 64 which is open at its right-hand (as seen in FIGS. 11 and 12) side. Pivotally attached to the block 60 by means of a pin 66, is a latch 68 having a laterally projecting pin 70 at its end remote from the pin 66, there also projecting from that end towards the side wall 62, a latch nose 72. When the shuttle 50 is at the loading station LS it cannot be moved therefrom towards the station CS, when the latch 68 is in a clockwise (as seen in FIG. 12) angular position, because the latch 68 interferes with a side wall 74 of the slide way 46, through an opening 76, in which wall, the latch 68 projects. In order to load the shuttle 50 with a connector 2, at the station LS, the operator raises the handle 52 from its FIG. 11 position, as indicated by the arrow F in FIG. 12, to an extent limited by a stop 82 on the front wall 56, against the action of a spring 76 connected to the lever 52 by a pin 78 and to the front wall 56 by a pin 80, whereby the latch 68 falls back to its FIG. 12 position. The operator then drops the connector 2 into the recess 64, in the direction of the arrow G in FIG. 12 and then returns the handle 52 in the direction of the arrow G1 in FIG. 11 to its FIG. 11 position, whereby a nose 86 on the handle 52, proximate to the pin 78, strikes the pin 70 on the latch 68, thereby pivoting the later towards the connector 2 in the direction of the arrow H in FIG. 11, so that the nose 72 engages the connector 2, between the projections 24 and 26 thereon, to hold the connector 2 fixedly positioned in the recess 64, the nose 86 on the handle 52 securing the latch 68 in its latching position, and the spring 76 retaining the handle 52 in its lowered position, that is to say in its normal position.

Mounted above the slide way 46, is a slide bar 83 secured to the frame plates 36 and 38. As best seen in FIG. 18, the slide bar 83, which is spaced back somewhat from the slide way 56, converges towards the slide way 56 in the rightward (as seen in FIGS. 5 and 18) sense. A cover transfer shuttle 85, which projects forwardly of the bar 83 to a position just rightward (as seen in FIG. 16) of the shuttle 50 is provided at its end remote from the shuttle 50, with rollers 87 which engage a depending rail 88 of the bar 83, so that the shuttle is slideable smoothly thereon lengthwise of the bar 83. The shuttle 85 is formed with a cover receiving recess 90 bounded on its forward side by a front plate 92 of the shuttle 85, an opening 93 in the upper side of the shuttle 85 communicating with the recess 90. A series of spring loaded cover retaining members 94 project into the rear side of the recess 90 and are depressable by a cover 14 inserted into the recess 90, against the action of springs 96. A handle 98 by means of which the shuttle 85 can be moved lengthwise of the bar 83 projects from the shuttle 85 for ready access by the operator. The shuttle 85 is movable between the center line CL1 of the cover removal station CS and the center line CL2 of the terminating station TS, as indicated by the arrow J in FIG. 18, to an extent limited by stops 100 and 102 on the bar 83. The shuttle 85 is further guided at the station CS by a guide plate 104 depending from the frame plate 40 (see FIGS. 16 and 17). Beneath the slide way 46 is a pneumatic piston and cylinder unit 106 which is mounted on the base plate 32 and has a piston rod 108 connected by an adaptor plate 110 guided in the bracket 44, to cover a shear block 112 having a shear edge 114 (FIG. 16) for cooperation with a shear edge 116 of the plate 92. The block 112 is drivable upwardly by the unit 106 as indicated by the arrow K in FIG. 16 against the action of return springs 119 acting between the plate 110 and the bracket 44. Pivotally mounted to the bracket 44 on a pivot pin 117 is a latch 118 having a latching nose 120 which is movable into and out of the guideway 46 between the positions in which the latch 118 is shown in FIGS. 9 and 10. The latch 118 is normally urged into a position obstructing the guideway 46 (FIG. 9), by a spring 122 but is pivotable to its FIG. 10 position in which the nose 120 is clear of the guideway 46, by means of a finger 124, mounted on a bracket 126 on the plate 110, when the piston rod 108 is in its advanced position.

Having loaded the connector 2 into the shuttle 50 as described above, and as shown in FIG. 8, the operator grasps the handle 52 and advances it as indicated by the arrows L in FIG. 13 so that the shuttle 50 is positioned at the cover removal station CS. As shown in FIG. 17, in this position of the shuttle, the cover 14 is positioned over the shear block 112 with hinges 18 of the connector 2 between the shear edges 114 and 116. Since the latch 118 is in its FIG. 9 position, obstructing the slide way 46, the shuttle 50 cannot further be advanced. When the shuttle 50 engages the nose 120 of the latch 118, a limit switch 200 is actuated to cause the unit 106 to advance its piston rod 108 so that the cover 14 is sheared, by the edges 114 and 116, from the housing 4 of the connector 2 and is driven up into the recess 90 of the shuttle 85, driving back the members 94 against the action of the springs 96 and thereby being firmly retained in the recess 90 by the members 94, which urge the cover 14 against the front plate 92 of the shuttle 84, as shown in FIG. 17. During the advance stroke of the piston rod 108, the finger 124 drove the latch 118 to its FIG. 10 position against the action of the spring 122 thereby allowing the operator to advance the shuttle 50, along the slide way 46 to the terminating station TS as indicated by the arrow M in FIG. 14, by pulling the handle 52 rightwardly, as seen in FIGS. 13 and 14. The unit 106 is then actuated to retract its piston rod 108, the latch 118 being held down by the shuttle 50.

The station TS comprises a wire insertion tool 130 having a row of depending wire insertion fingers 132 and being mounted for vertical sliding movement in a block 134 fixed to a bracket 136 depending from the frame 30. The tool 130 is secured by means of an adaptor 138 to the piston rod 140 of a pneumatic piston and cylinder drive unit 142 also fixed to the frame 30, and which is arranged to drive the tool 130 through a working stroke towards, and through a return stroke away from, the slide way 46 when a wire switch arm 144 is engaged by a wire W to cause the arm 144 in turn to actuate the switch arm 145 of a wire switch 146 mounted on a slide 145, for horizontal movement away from the reader, as seen in FIG. 19, against the action of a spring (not shown). At the station TS, the slide way 46 has in a side wall 148 thereof a spring loaded ball detent 140 for engaging the block 60 of the shuttle 50 releasably to hold it in its fully advanced position, at the station TS, in which position the shuttle 50 engages an end stop wall 152 of the slide way 46. There also projects into the slide way 46 above the detent 150, a sensor 154 for disabling the switch 146 when the shuttle 50 is not present in its end position in the slide way 46, at the station TS.

When the cover 14 has been received in the recess 90 of the shuttle 85, as described above, the operator advances the handle 52 to engage the shuttle 50 with the wall 152, thereby placing the connector 2, from which the cover 14 has been removed, directly beneath the tool 130. The operator then lays a first wire W on a wire support 156 (FIGS. 6 and 19) and advances the wire W through a wire guide 158 on a support plate 160 fixed to the block 134, to position the end portion of the wire W over a first cavity 6 of the housing 4 of the connector 2, with the end of the wire W engaging the switch arm 144 as indicated by broken lines in FIG. 19, so that the tool 130 is driven through a working stroke by the unit 142 to terminate the wire W to the terminal 8 in said cavity. The operator then terminates a wire to each terminal 8 of the connector 2, in the manner described above, until each terminal 8 of the connector 2 is connected to a wire. If the connector is designed for use with multiconductor flat cable (not shown), all the terminals of the connector can be connected to individual conductors of such a cable in a working single stroke of the tool 130. The shuttle 50 is not shown in FIGS. 6 and 19, the position of the connector 2 at the station TS being indicated by broken lines.

All the wires having been terminated as described above, the operator now advances the handle 98 rightwardly, as seen in FIGS. 14 and 15, and as indicated by the arrow P in FIG. 15 to position the shuttle 85 at the station TS as shown in FIG. 15 so that the recess 90 of the shuttle 84 lies beneath the tool 130, which is at the end of its return stroke, and between the tool 130 and the connector 2 in the shuttle 50, the latter pushing back the slide 147 to retract the switch arm 144 from between the tool 130 and the connector 2. Upon reaching its end position, determined by the stop 102 (FIG. 18), at the station TS, the shuttle 85 strikes a limit switch 164 mounted above the slide bar 83 on a bracket 166, thereby causing the unit 142 to drive the tool 130 through a working stroke through the opening 93 of the shuttle 85 to push the cover 14 out of the recess 90 against the action of the springs 96 and to force the cover 14 into latching engagement with the housing 4 of the connector 2 in the shuttle 50, so that the terminals 8, each of which has been connected to a wire W, are covered as shown in FIG. 3. The unit 142 now drives the tool 130 through a return stroke and the operator returns the shuttle 85 to the station CS and the shuttle 50 to the station LS, raises the arm 52, against the action of the spring 76, to its FIG. 12 position, lifts the wired connector 2 from the shuttle 50 and replaces it by an unwired connector.

What is claimed is:

1. For use with an electrical connector comprising an insulating housing having a terminal receiving cavity, an electrical terminal in the cavity and a cover removably hinged to the housing and being mateable therewith, apparatus for removing the cover from the housing, terminating an electrical wire to said terminal to provide an electrical connection between the wire and the terminal and then mating the cover with the housing to enclose said electrical connection, the apparatus comprising:

a connector housing loading station;

a wire terminating and cover mating station;

means for transferring the connector housing from said loading station to the terminating station;

a wire termination and cover mating tool mounted above said terminating station;

means for repeatedly driving the tool through a rectilinear downward working stroke towards the terminating station sequentially to terminate the wire to the terminal and to mate the cover with the connector housing, and through an upward return stroke away from the terminating station;

means for guiding the tool through its working stroke and its return stroke;

a cover removal station between the loading station and the terminating station;

means at the cover removal station for removing the cover from the housing; and means for then transferring the cover to the terminating station to position the cover between the terminating tool and the connector housing when the wire has been terminated by driving the tool through a first working stroke and the tool has been driven through a subsequent return stroke, to cause the cover to be mated with the housing by the tool during the next following working stroke thereof.

2. Apparatus according to claim 1, wherein the means for transferring the connector housing from the loading station to the terminating station comprises a first shuttle which is movable along a rectilinear path and which is arranged to dwell at the cover removal station, the means for transferring the cover from the cover removal station to the terminating station comprising a second shuttle having a recess therein and means for retaining the cover in the recess, the means for removing the cover from the housing being in the form of a shear block, a drive unit being provided for driving said block through a shearing stroke to shear the cover from the housing in cooperation with a shear plate, and to drive the cover into the recess, and then to drive said block through a return stroke.

3. Apparatus according to claim 2, wherein the first shuttle is slideable along a slide way extending between the loading station and the terminating station, the slide way being provided with a latch which is movable between a first position to obstruct the slide way threeby to prevent movement of the first shuttle from the cover removal station towards the terminating station, and a second position in which the latch is clear of the slide way, the latch being moved from its first to its second position by the shearing stroke of the shear block being returned to its first position by the return stroke of the shear block.

4. Apparatus according to claim 2, wherein the first shuttle is formed with a recess for receiving the connector housing at the loading station and a handle pivotally attached to the first shuttle for use in moving it from the loading station to the terminating station through the cover removal station, a housing latch also being provided on the first shuttle and being movable between a first position allowing the housing to be inserted into the housing receiving recess and a second position in which the housing latch engages the housing to secure it in the recess, the housing latch being movable between its first and its second positions by pivotal movement of the handle.

5. Apparatus according to claim 2, wherein the second shuttle has a handle for use in manually moving the second shuttle from the cover removal station to the terminating station and is supported by a slide bar extending from the cover removal station obliguely towards the terminating station.

6. Apparatus according to claim 2, wherein the terminating station is provided with a wire switch for actuation by the wire when it is inserted between the housing and the tool, when the housing is positioned at the terminating station, to cause the terminating tool to be driven through a working and a return stroke, the wire switch being displacable from the terminating station, by the second shuttle as it is moved into the terminating station.

7. For use with an electrical connector comprising an insulating housing having a terminal receiving cavity, an electrical terminal in the cavity and a cover removably attached to the housing and being mateable therewith, apparatus for removing the cover from the housing, terminating an electrical wire to the electrical terminal to provide an electrical connection between the wire and the terminal and for then mating the cover with the housing to enclose said electrical connection, the apparatus comprising:

a connector housing loading station;

a cover removal station having means for removing the cover from the housing and placing in it a cover transfer position;

means for transferring the housing from said loading station to said cover removal station;

a wire terminating and cover mating station;

means for transferring the housing from the cover removal station to said terminating and mating station when the cover has been removed from the housing by the cover removing means;

a wire terminating and cover mating tool mounted for reciprocating movement above said terminating and mating station;

means for repeatedly driving said tool from a raised position remote from said terminating and mating station, through consecutive rectilinear, downward first and second working strokes in a direction towards said terminating and mating station to terminate said wire to said terminal, and to mate said cover with said housing, respectively, and through an upward return stroke in a direction away from said terminating and mating station, following each of said working strokes; and means for transferring said cover from said cover transfer position to interpose it between said tool and said terminating and mating station in said raised position of said tool immediately following said first working stroke.

8. Apparatus according to claim 7, wherein the means for transferring the cover from the cover removal station to the terminating and cover mating station comprises a shuttle which is movable between these stations and is formed with a recess defining said cover transfer position when the shuttle is at the cover removal station, the means for removing the cover from the housing, comprising a shear block for supporting the housing and being mounted below the shuttle, a fixed shear blade at the cover removal station, and a drive unit for driving the shear block towards the shear blade to position the housing in the recess.

9. Apparatus according to claim 8, wherein the shuttle is provided with spring loaded, cover retaining members which project into said recess and which are depressable by the cover to retain it in the recess, as the cover is driven into the recess by the shear block.

10. Apparatus according to claim 8, wherein the means for transferring the connector housing from the housing loading station to the terminating and mating station, comprises a further shuttle, a spring loaded latch at the cover removal station being engageable in a recess in a slide way for the further shuttle to hold it at the cover removal station, the shear block being provided with means for engaging the latch, as the shear block is driven towards the shear plate, to displace the latch from the recess in the slideway.

11. Apparatus according to claim 7, wherein the means for transferring the housing from the loading station to the terminating station comprises a first shuttle which is movable along a rectilinear guide way extending through the cover removal station, by means of a handle on the first shuttle, means being provided at the cover removal station for obstructing the movement of the first shuttle along the guideway until the cover has been removed from the housing and placed in its cover transfer position, the means for transferring the cover from the cover removal station to the terminating station comprising a second shuttle supported by a slide bar extending from the cover removal station obliquely towards the terminating station, the second shuttle being movable by means of a handle thereon, along the slide bar from the cover removal station to the terminating and mating station.

* * * * *

UNITED STATES PATENT OFFICE

CERTIFICATE OF CORRECTION

Patent No. 4,718,159 Dated 1/12/88

Inventor(s) Udo Bronkowski et al.

It is certified that error appears in the above-identified patent and that said Letters Patent are hereby corrected as shown below:

In claim 5, column 7, line 58, replace -- obliguely -- with "obliquely".

Signed and Sealed this

Fifth Day of July, 1988

*Attest:*

DONALD J. QUIGG

*Attesting Officer*

*Commissioner of Patents and Trademarks*